US008156948B2

(12) United States Patent
Gatesoupe

(10) Patent No.: US 8,156,948 B2
(45) Date of Patent: Apr. 17, 2012

(54) COSMETIC PRODUCT COMPACT HAVING PIVOTING SECTIONS AND A PRODUCT APPLICATION DEVICE

(75) Inventor: Mathilde Gatesoupe, Asnieres-sur-Seine (FR)

(73) Assignee: L'Oreal, Paris (FR)

( * ) Notice: Subject to any disclaimer, the term of this patent is extended or adjusted under 35 U.S.C. 154(b) by 1126 days.

(21) Appl. No.: 11/755,557

(22) Filed: May 30, 2007

(65) Prior Publication Data

US 2008/0295857 A1 Dec. 4, 2008

(51) Int. Cl.
*A45D 33/32* (2006.01)

(52) U.S. Cl. ..... 132/295

(58) Field of Classification Search ..... 132/293–296, 132/301, 305; 206/823, 581
See application file for complete search history.

(56) References Cited

U.S. PATENT DOCUMENTS

| | | | | |
|---|---|---|---|---|
| 4,685,558 | A | 8/1987 | Filiz et al. | |
| 5,398,706 | A | 3/1995 | Epstein | |
| 5,515,875 | A | 5/1996 | Acker et al. | |
| 5,709,232 | A | 1/1998 | Sheffler et al. | |
| 6,237,612 | B1 | 5/2001 | Heyer | |
| 6,540,083 | B2 * | 4/2003 | Shih | 206/581 |
| 6,932,220 | B2 * | 8/2005 | Byun | 206/581 |
| 2003/0217761 | A1 | 11/2003 | Maelstaf | |

* cited by examiner

*Primary Examiner* — Rachel Steitz
(74) *Attorney, Agent, or Firm* — Oblon, Spivak, McClelland, Maier & Neustadt, L.L.P.

(57) ABSTRACT

A device such as a compact or product container includes a plurality of stacked sections or housings, which are pivotable with respect to each other. The sections are substantially aligned with each other when the device is in a closed position, and when pivoted with respect to each other, the device is opened to allow access to compartments or reservoirs of the different sections. According to an example, a lower housing or section can include a product application device to facilitate the application of the product contained in an upper section or housing. The product application device is held in the lower housing such that the hair of the product application device is not damaged by the pivoting of the plurality of stacked sections.

32 Claims, 3 Drawing Sheets

COSMETIC PRODUCT COMPACT HAVING PIVOTING SECTIONS AND A PRODUCT APPLICATION DEVICE

BACKGROUND OF THE INVENTION

1. Field of the Invention

This invention relates to a container for holding a cosmetic product and a device for applying the product. According to an example, the container has sections that are configured to pivot with respect to each other with one of the sections configured to hold the cosmetic product while another section is configured to hold the applicator device.

2. Description of the Related Art

Storage containers for cosmetics or the like, are known that have one or more storage parts for holding cosmetic products and applicators for applying the product. For example, U.S. Pat. No. 5,515,875 discloses a loose powder compact that includes a recessed area of a top closure panel that can accommodate an applicator or powder brush. The brush can be secured to the top of the top closure panel in order to isolate it from the loose powder disposed below the lower panel. In this way, the brush handle remains free of loose powder.

However, with the above discussed device, the brush is arranged in the top portion of the device, which prevents the user from seeing a cosmetic product stored therein. Additionally, having the brush located on top prevents quick access to the cosmetic product.

U.S. Pat. No. 5,398,706 discloses a cosmetic case that includes an upper cover portion that can be rotated with respect to a bottom portion. A drawer is included that has depressions for holding various components such a mirror and brushes. The drawer has the height and width of an opening and is slidably fitted within the opening transverse to the longitudinal orientation of the hair of the brush. As such, the hair of the brush can be damaged during the sliding movement of the drawer.

Additionally, a cosmetic storing device as discussed in U.S. Pat. No. 5,709,232, includes a completely separate storage compartment for a brush and also requires additional structure to secure the brush. Such a storage device can require a lot of space, which also may not be desirable.

Therefore, cosmetic compacts in the related art do not provide for a feature of having sections of a cosmetic device that pivot with respect to each other with one of the sections containing the cosmetic product and another of the sections containing at least an applicator brush. The applicator brush contained within a section is secured in a manner to reduce or prevent damage to the hair of the brush when the sections are rotated with respect to each other.

SUMMARY OF THE INVENTION

According to an aspect of the invention, it has been recognized that prior compact devices suffer from one or more disadvantages including: a cumbersome securing feature for the applicator brush, the brush including a handle and an applicator portion such as hair or any other material that can flare out when used by the consumer and/or less than satisfactory storage area for the brush allowing for the hair to be damaged by the movement of other portions of the cosmetic device.

The present invention relates to improved container and/or compact device. According to an example, the device includes a container that is suitable for packaging of a product with sections pivotable with respect to each other. For example, an upper section can be rotated with respect to a lower base section.

According to an example, the cosmetic device has multiple pivotable sections that store a variety of items. As an example, the sections can store a cosmetic product, a mirror, and an applicator brush for applying the cosmetic product. The applicator brush can be stored within one of the sections in a secured manner and can be positioned so that the movement of the sections to an opened or closed position does not damage the hair of the brush.

According to a further example, the brush can be stored in a bottom section and at least a portion of a bottom surface of section above the brush contacts the hair of the brush to sufficiently flatten the hair during rotation and storage and minimize or prevent damage to the hair.

One or more embodiments of the present invention can include, for example, a top pivoting section containing the cosmetic product, which can be viewed by the user, and a mirror and applicator brush located in a base pivoting section that can be non-visible to the user when the base section is in the closed position, which provides an aesthetically pleasing cosmetic container.

According to an example of the invention, the brush can be stored on top of the mirror and a portion of the brush can be engaged with an interior portion of the section, for example with a side wall of the section to help secure the brush within the compact device.

According to a further example, a portion of the handle of the brush can fit into a complimentary shaped groove formed in a side wall of the section to secure the brush for storage.

The device according to the invention may advantageously be used for packaging of a cosmetic or dermatological product, in the form of a liquid, soft, semi-soft, or hard product and a brush is provided for applying such products.

The invention can provide a number of advantageous features and benefits. It is to be understood that in practicing the invention, an embodiment can be constructed to include one or more features or benefits of embodiments disclosed herein, but not others. Accordingly, it is to be understood that the preferred embodiments discussed herein are provided as examples and are not be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as non-limiting examples of the invention. In the drawings.

DETAILED DESCRIPTION OF THE PREFERRED EMBODIMENTS

Figure 1:
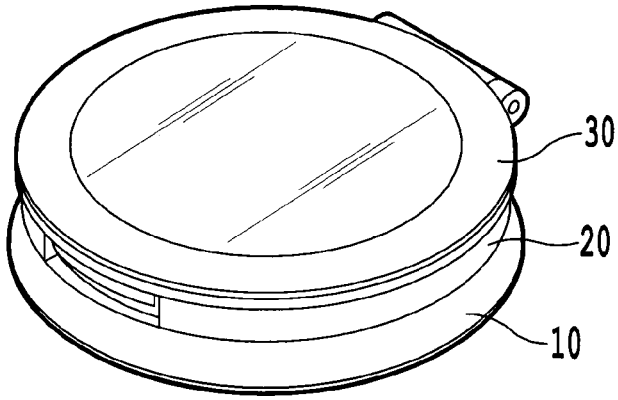
FIG. 1 is a schematic showing a compact device according to an example of the invention.

Reference will now be made in detail to the present preferred embodiments of the invention, examples of which are illustrated in the accompanying drawings. Wherever possible, the same reference characters will be used throughout the drawings to refer to the same or like parts.

As discussed earlier, during use of a compact device, an opening and closing of the compact could damage the hair of the brush stored therein. Additionally, a storage area that takes up a lot of space and is visible to the consumer may not be desirable.

Accordingly, the compact device of one or more examples of the invention preferably includes pivoting portions that open and close in a secure manner and will not damage the hair of a brush stored therein. It should be appreciated that the hair of the brush according to the following examples can be made of any material, be of any size, shape, and/or have any cross section.

Figure 2:
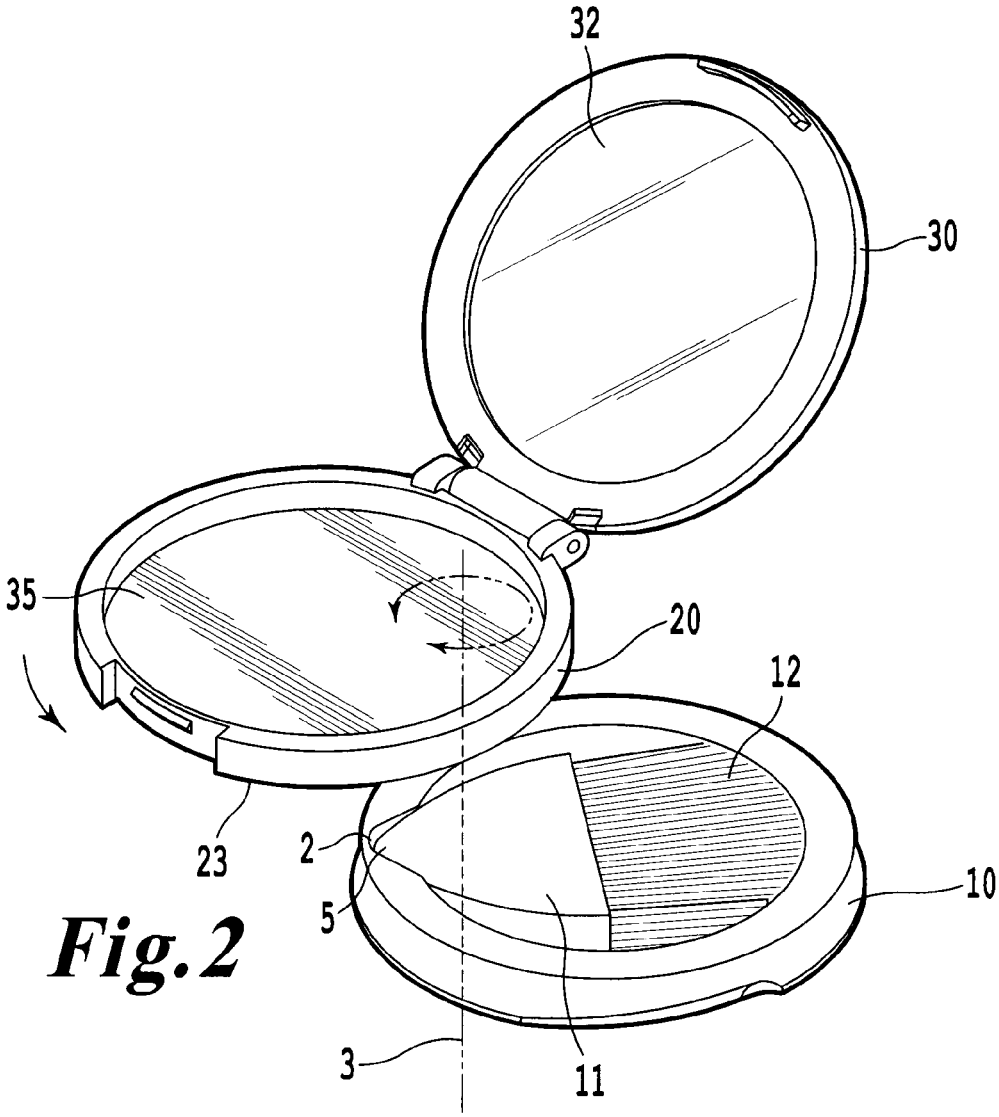
FIG. 2 is a schematic showing swiveling/pivoting sections according to an example of the invention.

FIGS. 1 and 2 are schematics showing the compact device according to one or more examples of the invention. The compact device can be a generally circular device that includes a base 10, center pivoting section 20, and a cover 30. The compact device is shown having the base 10 and center section 20 that pivot horizontally with respect to each other. In other words, during pivoting, relative movement of the sections is horizontal. In this example, the pivoting movement is about an axis 3 perpendicular to the base 10 and center 20 sections, for example, with the pivot axis perpendicular to the bottom of the base.

The compact device is shown in the figures as a generally circular device. However, examples of the invention can include a compact device having any desirable shape such as triangular, oval, square, rectangular, and the like. An example of the invention provides for at least a part of the outside side wall of one or more of the base 10, center section 20, and cover 30 to be tapered to form a gripping area for the user to place their hands when holding the compact. The side surfaces of the base 10, center 20, and/or cover 30 can have the same or different diameters, be any shape, such as curved and/or can be formed with protrusions or the like to provide the user with a secure grip on the compact device during use.

By way of example, the base 10 and center section 20 can be generally hollow structures with side walls and a bottom portion, as illustrated in the drawings. When in the closed position as shown in FIG. 1, the top of the base 10 can be closed by the bottom of the center section 20 and the top of the center section 20 can be closed by the cover 30. The hollow interior portions of the sections are configured to hold cosmetic products, brushes, mirrors, cosmetic pads, and the like, as discussed in more detail below.

FIG. 2 shows the compact device with the cover 30 open and the center section 20 and base 10 pivoted with respect to each other. According to the example shown in FIGS. 1 and 2, the center section 20 rotates with respect to the base, approximately 180 from the closed position to the opened position. Rotating the two sections this amount allows the user to have maximum access to the hollow interior portion of base 10. After rotating approximately 180 degrees, the center section 20 and base 10 can be locked into that position by a locking device (not shown). For example, the locking device can include a protrusion and a recess configured to receive the protrusion. The protrusion and the recess can be positioned on the center section 20 and the base 10, respectively, or vice-versa. Preferably, the entire hollow interior areas of the sections are fully accessible in the open position. For example, as shown in FIG. 2, an outer surface of the side wall of the center section 20 is substantially on a same plane as an interior surface of the side wall of base 10. This features allows the user to have full access to the interior of the base 10 without interference from a portion of, for example the side wall of, the center section 20. In accordance with this features, a mirror 9 (see FIG. 5) formed in the base 10 would be in full view to the consumer while applying a cosmetic product contained in the center section 20. Further, positioning the sections in this way will also allow the user to easily take out or replace items contained in the sections, such as a brush. However, it should be appreciated that examples of the invention provide for the base 10 and center 20 can be rotated to a locked position at any angle.

Figure 3:
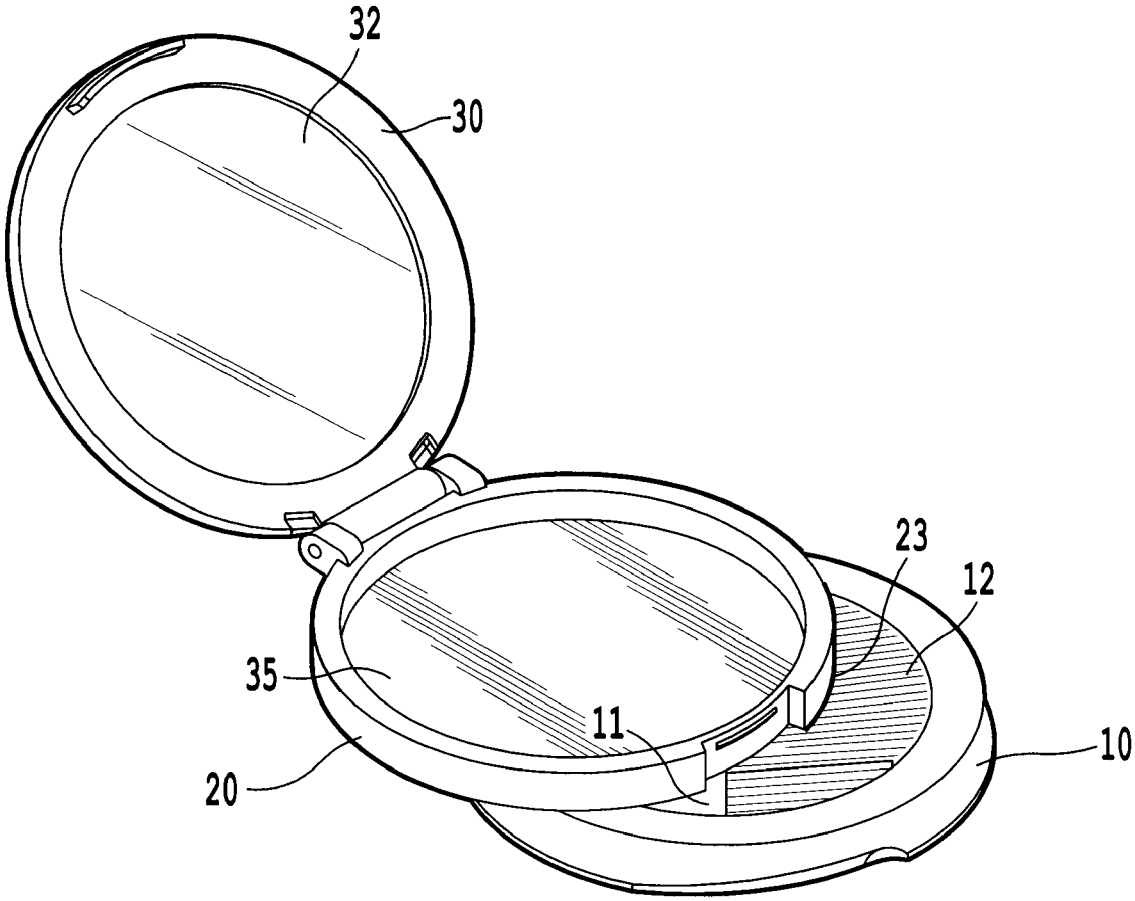
FIG. 3 is a schematic showing a brush secured in a section of the compact device according to an example of the invention.
Figure 5:
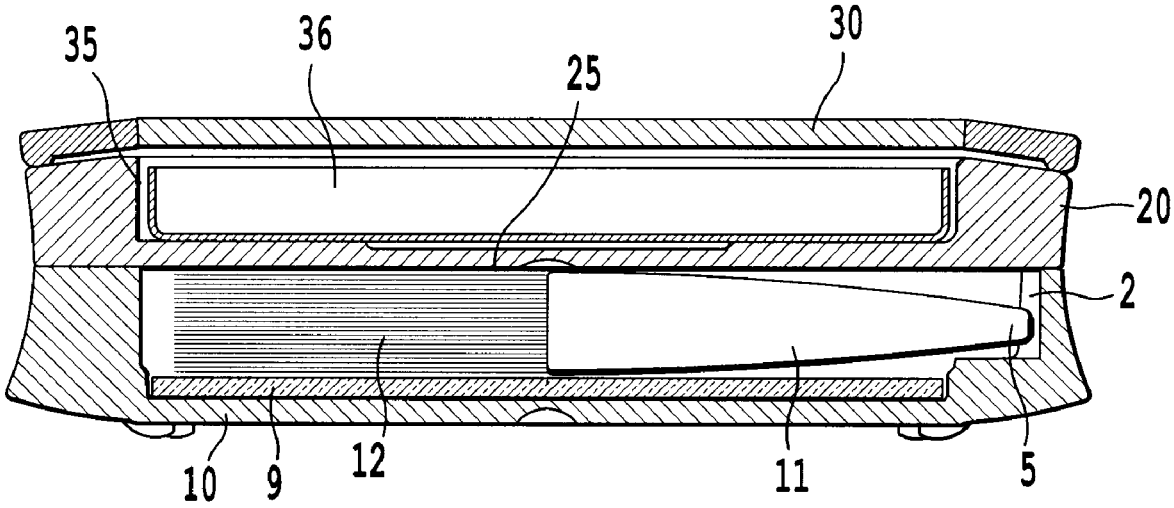
FIG. 5 is a cross-section of a compact according to an example of the invention.

According to a preferred embodiment of the invention, as best shown in FIGS. 2, 3 and 5, the hollow interior portion of the center section 20 is a reservoir or containing area 35 for the product 36 to be stored. The product can be for example, a lip product, a skin product, or other type of make-up or dermatological product and can be in the form of, for example, a liquid, a gel, a cream, powder and can have the consistency of, for example, a solid or cake, pasty, semi-soft, or flowable product. The cover 30 can include a transparent area 32 to allow the user to see through the cover 30 at the product contained therein to eliminate the need to open the compact to determine what is inside.

According to an example of the invention, the base 10 can include both a mirror 9 and a brush 11 for use by the consumer during application of the product. It should be appreciated that either the base 10 or center section 20 can contain a cosmetic product 36, a brush 11, an applicator pad, and/or a mirror 9. Further, an indentation 2 can be formed in a side wall of the base 10 and/or in the center section 20, to accommodate a portion of a brush 11. For example, at least a portion of the brush handle 5 can fit into the indentation 2 when the brush 11 is stored in the base 10. The brush handle 5 or any portion thereof, can be any aesthetic or functional shape such as square, triangular, and the like that will allow a securing fit into the indentation 2 having a complementary shape. While the indentation 2 is illustrated as provided in the side wall of the base 10 and the brush handle 5 is shaped to fit into the indentation 2, an example of the invention provides for this configuration to be reversed. For example, a protrusion can be formed in the side wall that projects out into an indentation formed in the handle 5 having a complementary shape to the protrusion.

Additionally, according to an example of the invention, the exposed end portion of the hair 12 can be shaped to fit the contour of the inside of the base 10. For example, with a circular base 10 as shown in the figures, the end of the hair will curve to complement the curve of the base 10. As such, when the handle 5 is placed in the indentation 2, the length of the brush from an end of the handle 5 to an end of the hair 12 will allow for the brush 11 to completely fit within the confines of the hollow interior portion of the base 10. For example, as best shown in FIG. 5, the brush 11 will be stored in a substantially horizontal manner with respect to a bottom surface of the base 10 if the portion of the handle 5 is placed into the indentation 2 when the user stores the brush 11. If a user does not orient the brush in the correct way, the brush 11 will be situated at an angle and the user will not be able to close the compact device over the brush without potentially damaging the brush. According to this example, with the indentation 2 formed in the side wall, the proper placement of the brush 11 during storage is ensured and damage to the hair 12 during rotation of the sections can be reduced or prevented as discussed in greater detail below.

When a user has used the brush 11 to apply the product and has returned the brush 11 to the base 10, the center 20 is rotated closed with respect to the base 10. As best shown in FIGS. 2 and 3 and in accordance with one or more examples of the invention, the indentation 2 is formed at a location in the side wall of the base 10 such that when the brush 11 is placed in its storage position in the base 10 and the center 20 is rotated with respect to the base 10, a bottom of the center section 20 slides along a substantially longitudinal direction of the hair 12 and handle 5 of brush 11. Accordingly, as shown in FIG. 3, when the center 20 is rotated closed, a front edge 23 of the bottom of the center section 20 will slide over the handle 5 first and then over the hair 12 portion in a generally longitudinal direction of the brush 11. As the center 20 is rotated and passes over the brush 11, the front edge 23 located at the bottom of the center section 20 can contact the hair 12 as it passes over the hair 12 to the closed position. That contact between the front edge 23 and the hair 12 can first take place at or near the base of the hair 12 (where it connects to the handle 5) and can progress toward the tip of the hair 12 as the front edge 23 approaches the edge of the base 10 during the closing movement. Due to the contact with the front edge 23 of the center section 20 as the center section 20 is rotated, the hair 12 is pushed completely into the hollow interior portion of the base 10. According to this feature of the invention, the hair 12 is safely flattened into the interior of base 10 and is not damaged by the pivoting section of the compact device.

Figure 4:
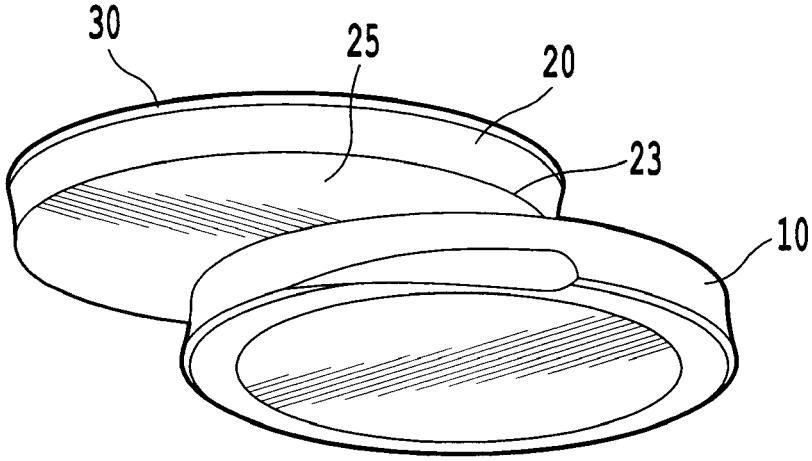
FIG. 4 is a side view of a compact device according to an example of the invention.

According to a further example of the invention, as shown in FIGS. 4 and 5, the bottom 25 of the center section 20 can have a substantially uniform depth across the entire bottom surface. For example, the bottom 25 surface can be substantially coplanar with the front edge 23 used to flatten the hair 12 into the base 10. As such, when the center 20 is rotated and the front edge 23 flattens the hair 12 of the brush 11 as discussed above, at least a portion of the bottom surface 25 will continue to have contact with the hair 12 and flatten the hair 12 as the brush 11 is stored. In accordance with this feature, as the center section 20 and base 10 are rotated open, the hair 12 will not extend out of the hollow interior of the base 10 until after the bottom surface 25 of the center 20 contacting the hair has rotated past the hair 12. Therefore, the hair 12 will be prevented from extending out of the hollow interior of base 10 while the base 10 and center 20 are rotated and thus, will be protected from the sections damaging the hair 12.

In the example shown, the indentation 2 and the brush 11 can be oriented such that the area of the bottom surface 25 in contact with the hair 12, does not move across the hair 12 in a direction transverse to the orientation of the hair 12. That is, as the base 10 and center section 20 are rotated, the part of the bottom surface 25 contacts one or more portions of the brush 11 so as to slide along a longitudinal direction of the hair 12. Therefore, damage to the hair 12 of the brush is reduced or eliminated by the opening and closing of the cosmetic device.

In an illustrated example of the present invention, the longitudinal axis of the hair 12 and/or indentation 2 is positioned with respect to the pivot axis 3 so as to make an angle relative to the center of the base 10 of about 60 degrees. Other angles are possible, for example in a range of about 10 to 110 degrees and more particularly in a range of about 45 to 75 degrees. These angles provide the beneficial function of reducing damage to the hair 12 of the brush 11 as the center section 20 and the base 10 pivot back and forth between the open and closed positions. It is within the spirit and scope of the invention to have the handle 5 and the indentation 2 formed to have complementary shapes and sizes and be oriented at other angles with respect to the pivot axis 3 and the center of the base 10 as long as the brush can be positioned inside the base 10 and the hair 12 not be damaged by opening and closing the base 10 and center section 20 assembly. For example, the handle 5 can have an elbow shape, or a curved shape, so that the handle 5 is not fully longitudinal with respect to the hair 12 of the brush. In such an embodiment, the indentation 2 can be placed at an angle outside the above range for example, such that the front edge 23 slides over the hair 12 in a longitudinal direction with respect to the hair 12, so as to not damage the hair 12.

It should be appreciated that in one example, the bottom surface 25 of the center 20 has only a portion of the surface 25 contacting the hair 12 during rotation of the base 10 and center 20. For example, only a portion of the bottom surface 25 will be substantially coplanar with a top edge of the base 10 in an area that contacts the hair 12.

It is within the spirit and scope of one or more examples of the invention to have any number of sections that can pivot with respect to each other. For example, a base 10 can be provided along with two sections 20, and a cover 30. The base 10 and sections 20 would be able to rotate with respect to each other in a similar manner as described above. Where additional pivotable sections are provided, they can pivot about a common axis or plural coaxial axes, or alternatively, they can pivot about axes that are at different locations about the periphery of the compact. As such, according to an example of the invention, several sections 20 can contain product application devices, such as brushes 11, and therefore the brushes will be oriented in order to reduce or eliminate damage to the brush hair 12 as the pivoting sections are rotated.

Obviously, numerous modifications and variations of the present invention are possible in light of the above teachings. It is therefore to be understood that within the scope of the appended claims, the invention may be practiced otherwise than as specifically described herein.

The invention claimed is:

1. A device for containing a product, comprising:

a plurality of stacked sections pivotable with respect to each other about an axis and a locking device to secure a first of the plurality of stacked sections with a second of the plurality of stacked sections in an opened position, wherein the sections are substantially aligned with each other when the device is in a closed position, wherein the sections are not aligned with each other when the sections are pivoted with respect to each other in a direction transverse to the axis such that the device is in the opened position, wherein a first section of the plurality of stacked sections is stacked over a second of the plurality of stacked sections, the second stacked section including a side wall having an inner surface facing an interior of the second stacked section, and an outer surface facing an exterior of the second stacked section, wherein the second of the plurality of stacked sections holds a product application device, an opening of the second section being not parallel to the pivot axis, wherein the product application device has a gripping portion and an application portion, wherein the second section includes a groove formed in the inner surface of the side wall of the second section, and a tip end of the gripping portion at an opposite end of the product application device from the application portion, is complimentarily shaped with the groove so the tip end fits within the groove to secure the entire product application device within the second section, wherein when the first section and the second section are pivoted with respect to each other to a fully opened position, an outside edge of a side wall of the first section adjacent the pivot axis extends across and overlaps a portion of the side wall of the second section only to the inner surface of the side wall of the second section such that the outside edge of the side wall of the first section does not overlap the interior of the second stacked section, wherein the groove formed in the inner surface of the side wall of the second section is located at a position at the side wall distant from the overlap between the first section and second section in the opened position, and wherein the first section is configured to rotate approximately 180 degrees with respect to the second section, to said opened position.

2. The device according to claim 1, wherein the second section is a base section formed as a lowermost section, the first section is formed above the base section and is secured to the base section by a securing device formed in a mating area of the first and second sections.

3. The device according to claim 2, wherein the product application device is a brush, and the application portion including hair for retaining and applying the product to a user.

4. The device according to claim 3, wherein one or more of the plurality of sections have hollow interiors.

5. The device according to claim 4, wherein a hollow interior of the first section is configured to contain one of a cosmetic product and a cosmetic pad.

6. The device according to claim 4, wherein a hollow interior of the second section is configured to contain a mirror.

7. The device according to claim 3, wherein at least a portion of the brush rests on a surface of a mirror during storage of the brush in the second section.

8. The device according to claim 3, wherein at least a portion of a bottom surface of a hollow interior of the second section includes a mirror and the brush is stored on top of the mirror.

9. The device according to claim 7, wherein when the first and second sections are aligned, the brush is completely contained within a hollow interior of the second section.

10. The device according to claim 8, wherein when the first and second sections are in said open position, the user can remove the brush and have an unobstructed view of the mirror.

11. The device according to claim 3, wherein when the first and second sections rotate with respect to each other from said opened position to said closed position, a bottom surface of the first section slides across and contacts the hair of the brush.

12. The device according to claim 11, wherein when the first and second sections rotate from said opened position to said closed position, an edge of the bottom surface first pushes the hair down into a hollow interior of the second section.

13. The device according to claim 12, wherein the bottom surface of the first section is configured to contact at least a portion of the brush when the sections are aligned in said closed position and the brush is stored in the second section.

14. The device according to claim 3, wherein when the plurality of sections are substantially aligned, the brush is completely contained within a hollow interior of the second section.

15. The device according to claim 14, wherein the device is formed to have a circular shape.

16. The device according to claim 15, wherein an end of the brush hair furthest away from a handle of the brush, has a curved shape to substantially match a curve of the circular device.

17. The device according to claim 1, further comprising a lid, wherein at least a portion of the lid includes a transparent area to allow the product contained therein to be seen.

18. The device according to claim 1, wherein the product is a cosmetic product.

19. A device for containing a product, comprising:

a first section;

a second section; and a locking device to secure the first section with the second section in an opened position wherein the first and second sections are pivotable with respect to each other about an axis, wherein the first and second sections are substantially aligned with each other when the device is in a closed position, wherein the first and second sections are not aligned with each other when the sections are pivoted with respect to each other in a direction transverse to the axis such that the device is in the opened position, wherein the first section is configured to rotate approximately 180 degrees with respect to the second section, to said opened position, wherein the first section is stacked above the second section, the second section holds a brush having hair, the second stacked section including a side wall having an inner surface facing an interior of the second stacked section, and an outer surface facing an exterior of the second stacked section, wherein when the first section and the second section are pivoted with respect to each other to a fully opened position, an outside edge of a side wall of the first section adjacent the axis extends across and overlaps a portion of the side wall of the second section only to the inner surface of the side wall of the second section such that the outside edge of the side wall of the first section does not overlap the interior of the second stacked section, and wherein when the first and second sections are rotated opened or closed with respect to each other, at least one of a bottom surface and a front edge of the first section slides across a substantially longitudinal direction of the hair of the brush.

20. The device according to claim 19, wherein during closing of the first and second sections with respect to each other, the front edge of the first section pushes the hair down into a hollow interior of the second section.

21. The device according to claim 19, wherein when the sections are substantially aligned, the brush is completely contained within a hollow interior of the second section, and wherein at least a portion of the bottom surface of the first section is configured to remain in contact with at least a portion of the hair of the brush when the sections are aligned and the brush is stored in the second section.

22. The device according to claim 21, wherein the second section includes a securing relief formed in a side wall, the securing relief is configured to receive at least a part of a gripping portion of the brush.

23. The device according to claim 19, wherein when the sections are substantially aligned, the brush is completely contained within a hollow interior of the second section.

24. The device according to claim 22, wherein the securing relief is positioned so that the brush, when stored therein, is oriented to allow the first section to slide across the hair of the brush along the substantially longitudinal direction of the hair.

25. The device according to claim 19, wherein the product is a cosmetic product.

26. A device for containing a product, comprising:

a first section;

a second section pivotable with respect to the first section about an axis, the second section including a side wall have an inner surface facing an interior of the second section, and an outer surface facing an exterior of the second section; and a locking device to secure the first section with the second section in an opened position wherein the first and second sections are substantially aligned with each other when the device is in a closed position, wherein the first and second sections are not aligned with each other when the sections are pivoted with respect to each other in a direction transverse to the axis such that the device is in the opened position, wherein the first section is configured to rotate approximately 180 degrees with respect to the second section, to said opened position, wherein when the first and second sections are pivoted to the opened position, an outside edge of a side wall of the first section adjacent the axis extends across and overlaps a portion of the side wall of the second section only to the inner surface of the side wall of the second section such that the outside edge of the side wall of the first section does not overlap the interior of the second section, wherein the first section is stacked over the second section, wherein the second section holds a brush having a gripping portion and hair, with a first end of the hair secured to the gripping portion, wherein the second section includes a securing relief formed in a side wall that is configured to receive at least a part of the gripping portion, and wherein when the first and second sections are rotated opened or closed with respect to each other, a longitudinal axis of the hair is oriented substantially parallel to a movement of a front edge of the first section when the front edge slides over the first end of the hair.

27. The device according to claim 26, wherein the longitudinal axis of the hair is oriented such that the longitudinal axis and the pivot axis form an angle of approximately 45 degrees to approximately 75 degrees with respect to a center of the second section.

28. The device according to claim 26, wherein the longitudinal axis of the hair is oriented such that the longitudinal axis and the pivot axis form an angle of approximately 60 degrees with respect to a center of the second section.

29. The device according to claim 27, wherein the securing relief is positioned in the side wall at a position substantially along the longitudinal axis of the hair.

30. The device according to claim 26, wherein during closing of the first and second sections with respect to each other, the front edge of the first section pushes the hair down into a hollow interior of the second section.

31. The device according to claim 29, wherein when the sections are substantially aligned, the brush is completely contained within a hollow interior of the second section, and wherein at least a portion of a bottom surface of the first section is configured to remain in contact with at least a portion of the hair of the brush when the sections are aligned and the brush is stored in the second section.

32. The device according to claim 26, wherein the first section is configured to contain a cosmetic product.

* * * * *